US005713156A

United States Patent [19]

Briggs, Sr.

[11] Patent Number: 5,713,156

[45] Date of Patent: Feb. 3, 1998

[54] SHUTTER FOR CURVED WINDOWS

[75] Inventor: Kenneth W. Briggs, Sr., Rice, Tex.

[73] Assignee: Rushman Industries, Dallas, Tex.

[21] Appl. No.: 603,733

[22] Filed: Feb. 20, 1996

[51] Int. Cl.[6] ..... E06B 7/096

[52] U.S. Cl. ..... 49/82.1; 49/74.1; 49/92.1

[58] Field of Search ..... 49/74.1, 82.1, 49/92.1, 371

[56] References Cited

U.S. PATENT DOCUMENTS

| | | | |
|---|---|---|---|
| 705,202 | 7/1902 | Buckman | 49/82.1 X |
| 3,075,257 | 1/1963 | Rosen | 49/74.1 X |
| 5,216,837 | 6/1993 | Cleaver et al. | 49/74.1 X |
| 5,469,658 | 11/1995 | Digianni et al. | 49/74.1 X |
| 5,471,789 | 12/1995 | Faircloth | 49/74.1 |
| 5,537,780 | 7/1996 | Cleaver et al. | 49/82.1 |

*Primary Examiner*—Kenneth J. Dorner
*Assistant Examiner*—Curtis Cohen
*Attorney, Agent, or Firm*—Roger C. Clapp

[57] ABSTRACT

A window shutter having pivoting louvers radially mounted in an arcuate frame. Each louver has a narrow end mounted to an inner frame member, a wide end mounted to an outer frame member, and two diverging lateral sides. The wide louver end is pivotally mounted to the outer frame member by a mounting pin extending into the wide end and into the outer frame member. The narrow louver end is securely mounted to a pinion gear which meshes with arcuate front and rear rack gears which are slidably mounted in the inner frame member. The shaft of each pinion gear extends into the inner frame member to rotatably mount the gear thereto. Rotation of a single pinion gear causes a corresponding arcuate movement of the rack gears in opposite directions. Movement of the rack gears, in turn, rotates all pinion gears and all louvers simultaneously. The rack gears may also be directly positioned to rotate the louvers. The total range of movement of the rack gears cause a 180° rotation of the louvers.

5 Claims, 2 Drawing Sheets

SHUTTER FOR CURVED WINDOWS

BACKGROUND OF THE INVENTION

1. Field of the Invention

The invention relates to window shutters, and more particularly, to a window shutter having pivoting louvers radially mounted in an arcuate frame for shuttering curved windows.

2. History of Related Art

Decorative shutters employing pivoting louvers for selection of the amount of light admitted thereby are well known in the art. Typical decorative shutters have movable louvers, pivotally mounted in a frame, and ganged together for common movement by a rod or stick mounted down the center of the shutter assembly and secured by means of staples or other fasteners to the edge of each louver.

U.S. Pat. No. 4,974,362 to Briggs, Sr. discloses a window shutter having pivoting louvers mounted in a rectangular frame and linked together for common pivotal movement by a metallic ganging bar mounted adjacent to the ends of the louvers. The louvers are retained in positions selected by a user by means of a pair of magnets mounted in the frame adjacent to the metallic ganging bar.

Existing shutters, such as those described above, are suitable only for mounting in standard, rectangular windows. Many offices and homes, however, have decorative, architecturally pleasing curved windows such as semi-circular windows which may be placed, for example, over doors or standard rectangular windows. Shutters for such semi-circular windows, sometimes referred to as "sunburst" shutters, utilize wedge-shaped louvers which typically must be adjusted individually. Some attempt at ganging the louvers have been made, but the results have not been satisfactory. Prior assemblies have been complex, difficult to manufacture, and cumbersome for users to operate.

Alternatively, occupants of such offices or homes could use existing rectangular shutters for the rectangular portion of their windows, but either leave the upper, semi-circular windows uncovered or cover them with a custom-made drapery. If the semi-circular windows were left uncovered, occupants suffered a loss of privacy and entry of an uncontrolled amount of light and heat. If the windows were covered by a drapery, occupants lost part of their external view and could not easily adjust the amount of light and heat admitted through the semi-circular window.

It would be a distinct advantage to have a window shutter that fits into a curved window such as a semi-circular window and provides pivoting louvers that are synchronized with a mechanism that is simple, of straight-forward manufacture, and is easy to operate. Such a shutter may be easily and quickly closed for darkness and/or privacy, or selectably opened to any degree to admit a desired amount of light. The present invention provides such a shutter.

SUMMARY OF THE INVENTION

The present invention is a shutter for curved windows. The shutter comprises a frame having an inner free member and an outer frame member, a plurality of louvers radially mounted between the inner frame member and the outer frame member, and means for synchronously pivoting the plurality of louvers. The means for pivoting the plurality of louvers includes a rack and pinion gear assembly comprising a slidably mounted arcuate rack gear and a plurality of pinion gears meshed with the arcuate rack gear. Each of the plurality of louvers is securely mounted to an associated one of the plurality of pinion gears and pivots as its associated pinion gear routes due to arcuate movement of the rack gear.

BRIEF DESCRIPTION OF THE DRAWINGS

The invention will be better understood and its numerous objects and advantages will become more apparent to those skilled in the art by reference to the following drawing, in conjunction with the accompanying specification, in which.

DETAILED DESCRIPTION OF EMBODIMENTS

Figure 1:
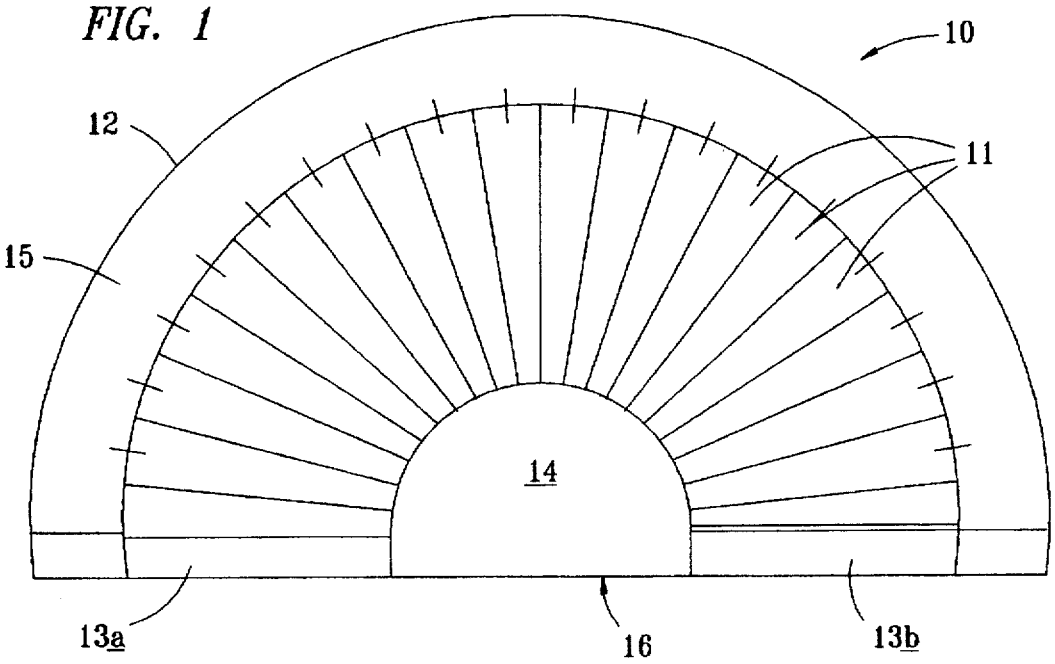
FIG. 1 is a front side elevational view of a shutter constructed in accordance with the teachings of the present invention.

FIG. 1 is a from side elevational view of a shutter 10 constructed in accordance with the teachings of the present invention. The shutter 10 includes a plurality of louvers 11 radially mounted within a frame 12. The frame 12 comprises base frame members 13*a* and 13*b*, a semi-circular inner frame member 14, and an arcuate outer frame member 15 which subscribes a semi-circle. The inner frame member 14 is covered by a cover plate 16. In FIG. 1, the louvers 11 are in the fully closed position. It should be noted that the semi-circular configuration of the shutter 10 of FIG. 1 is exemplary only, and the present invention may be utilized to shutter curved windows that form more than or less than a semi-circle.

Figure 2:
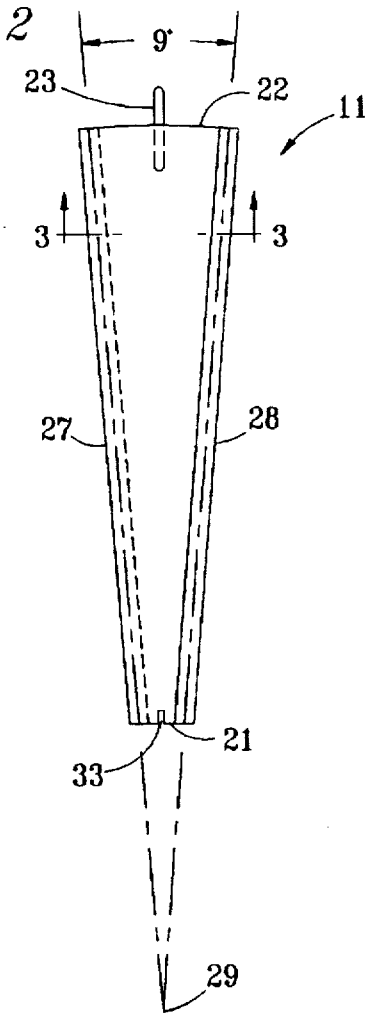
FIG. 2 is a front side elevational view of a louver in the preferred embodiment of the present invention.

FIG. 2 is a front-side elevational view of a louver 11 in the preferred embodiment of the present invention. Each louver has a narrow end 21 mounted to the inner frame member 14 toward the center of the shutter and a wide end 22 mounted to the outer frame member 15 toward the outer edge of the shutter. The wide louver end 22 is pivotally mounted to the outer frame member 15 by a mounting pin 23 extending into the wide end 22 and into the outer frame member 15. The narrow louver end 21 is securely mounted to a pinion gear 24 (see FIG. 5) which meshes with an arcuate front rack gear 25 and an arcuate rear rack gear 26 (see FIGS. 4 and 6). The rack gears are slidably mounted in the inner frame member 14.

The degree of divergence of the width of each louver 11 causes the wide louver end 22 to cover the angular window area. In the preferred embodiment illustrated in FIG. 1, there are 20 louvers, each with an angular width of 9° (i.e., the lateral sides diverge at a 9° angle). The louvers 11 are mounted at 9° intervals to cover the 180° semi-circular window.

It may be seen in FIG. 2 that the louver has lateral sides 27 and 28, and the lateral sides diverge from a focal point 29 located at the center of radius of the inner and outer frame members 14 and 15. Therefore, when mounted at the 9° interval described above, the lateral sides 27 and 28 of each louver are parallel to and flush against the sides of adjacent louvers when in the fully closed position illustrated in FIG. 1.

Figure 3:
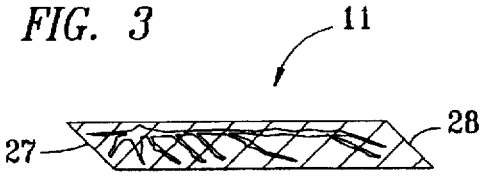
FIG. 3 is a cross-sectional view of a louver taken along line 3—3 in FIG. 2.

FIG. 3 is a cross-sectional view of a louver 11 taken along line 3—3 in FIG. 2. Lateral side 27 is tapered at a 45° angle from back-to-front, and lateral side 28 is tapered at a 45° angle from front-to-back. The 9° width of each louver is measured to the mid-point of each taper. Thus, the sides of adjacent louvers overlap slightly when in the fully closed position, thereby providing a more light-tight shutter. In the preferred embodiment, the louvers are constructed of wood, providing a rigid structure, the sides of which can be easily tapered using standard woodworking equipment.

Figure 4:
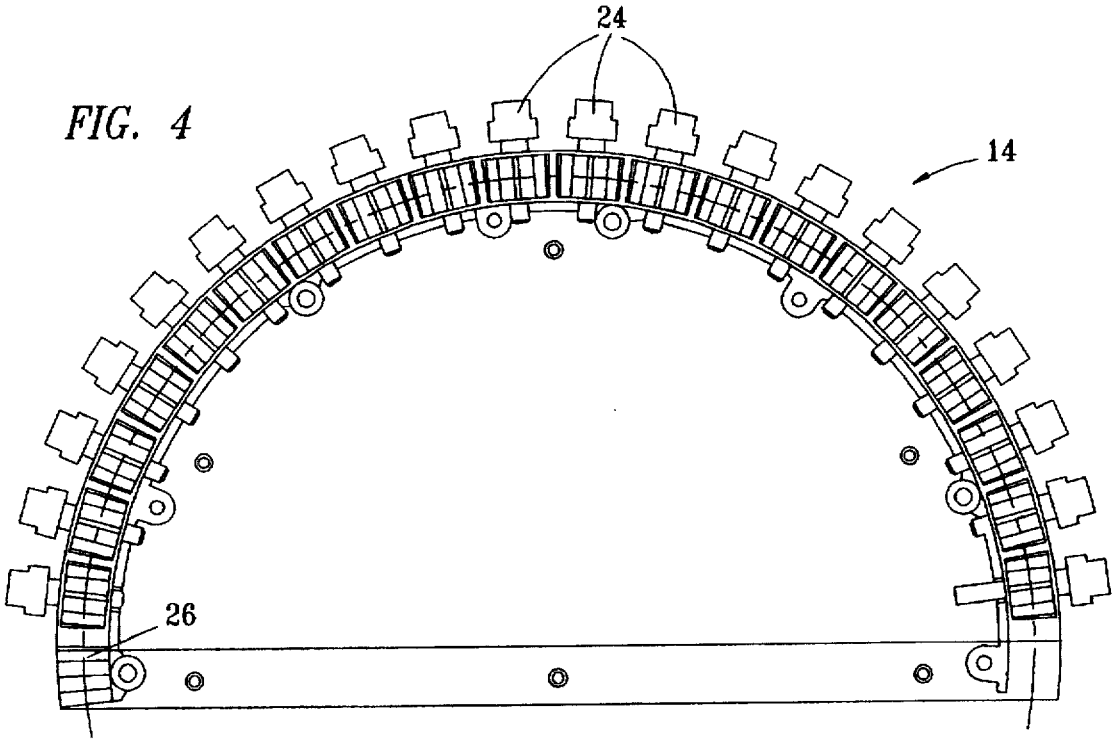
FIG. 4 is a front side elevational view of the inner frame member with the cover plate and a front rack gear removed to show a rear rack gear and a plurality of pinion gears for pivoting the louvers in the preferred embodiment of the present invention.

FIG. 4 is a front side elevational view of the inner frame member 14 with the cover plate 16 and front rack gear 25 removed to show a rack and pinion gear assembly comprising a rear rack gear 26 and a plurality of pinion gears 24 for pivoting the louvers 11 in the preferred embodiment of the present invention. The narrow end 21 of each louver 11 is securely mounted to one of the pinion gears 24.

Figure 5:
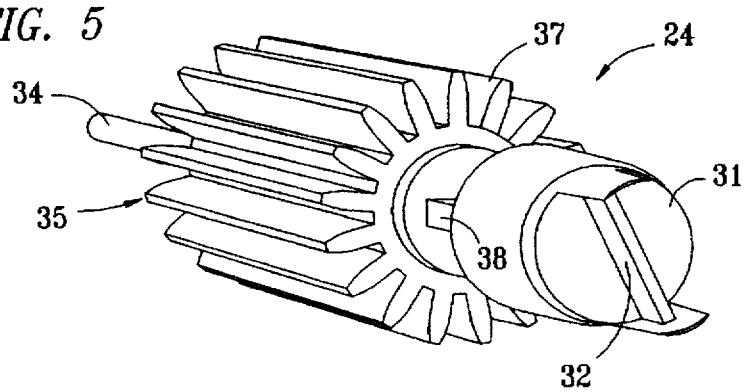
FIG. 5 is a perspective view of a pinion gear utilized in the preferred embodiment of the present invention.

FIG. 5 is a perspective view of a two-piece pinion gear 24 utilized in the preferred embodiment of the present invention. The outer end 31 of the first component of the pinion gear includes a transverse tab 32 which slides into a slot 33 (FIG. 2) in the narrow end 21 of an associated louver for securely mounting the louver to the pinion gear. A shaft 34 extends from outer end 31 to the inner end 35 of said first component of the pinion gear 24. The shaft 34 of each pinion gear extends into the inner frame member 14 to mount the gear thereto. The gear body 37 is slidably mounted on shaft 34, which has a rectangular section 38 dimensioned to receive the gear body 37 in only one orientation so that each gear body 37 is located in a single orientation with respect to transverse tab 32, and thus its associated louver.

Referring again to FIG. 4, the rack gears 25 and 26 are slidably mounted in the semi-circular inner frame member 14 and are slightly shorter than the inner frame member to allow arcuate movement of the rack gears. The rack gears move in opposite directions causing simultaneous rotation of all pinion gears 24 and pivoting of the louvers 11 attached thereto. The total range of movement of the rack gears causes a 180° rotation of the louvers. A single louver 11 may be rotated, thereby rotating its associated pinion gear 24, positioning the rack gears 25 and 26, and rotating all other pinion gears simultaneously. In an alternative embodiment, the rack and pinion gear assembly may include only a single rack gear. However, two rack gears are utilized in the preferred embodiment for smoothness and reliability of shutter operation.

Figure 6:
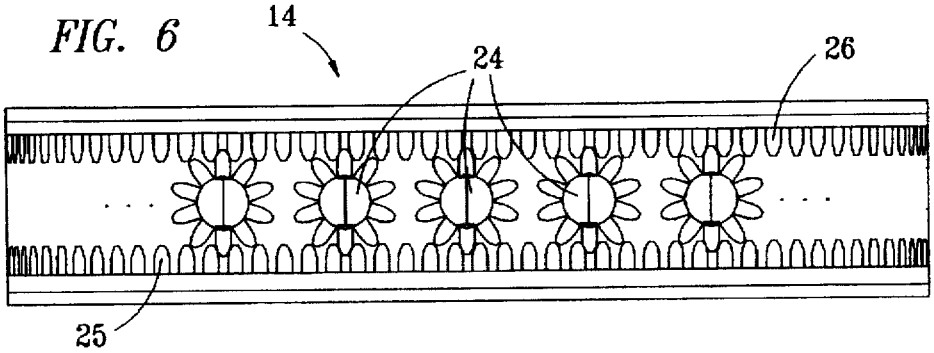
FIG. 6 is a top side view of the inner frame member of FIG. 4 showing the front and rear rack gears and the plurality of pinion gears.

FIG. 6 is a top side view of the inner frame member 14 of FIG. 4 showing the front rack gear 25, the rear rack gear 26, and the plurality of pinion gears 24. Arcuate movement of the rack gears 25 and 26 in opposite directions causes simultaneous rotation of all pinion gears 24 and pivoting of the louvers 11 attached thereto. The user, in order to open or close the louvers, rotates a single louver 11, thereby rotating its associated pinion gear 24, positioning the rack gears 25 and 26, and routing all other pinion gears simultaneously to pivot their associated louvers synchronously with the manually rotated louver.

It is thus believed that the operation and construction of the present invention will be apparent from the foregoing description. While the shutter shown and described has been characterized as preferred, it will be readily apparent that various changes and modifications could be made therein without departing from the spirit and scope of the invention as defined in the following claims.

What is claimed is:

1. A shutter for curved windows comprising:

a frame having an inner frame member and an outer frame member;

a plurality of radially extending louvers, each of said plurality of louvers having a narrow end, a wide end, and two diverging lateral sides; and each being mounted to said inner frame member at said narrow end, and to said outer frame member at said wide end by means of a mounting pin extending into said outer frame member and into said wide end; and a rack and pinion gear assembly in said frame for engaging synchronously said plurality of louvers, said assembly comprising a pair of opposing slidably mounted arcuate rack gears and a plurality of pinion gears mounted between each of said pair of arcuate rack gears.

2. A shutter for curved windows comprising:

a frame having an inner frame member and an outer frame member;

a plurality of radially extending louvers, each of said plurality of louvers having a narrow end, a wide end, and two diverging lateral sides; and each being mounted to said inner frame member at said narrow end, and to said outer frame member at said wide end by means of a mounting pin extending into said outer frame member and into said wide end; and a rack and pinion gear assembly in said frame for engaging synchronously said plurality of louvers, said assembly comprising a slidably mounted arcuate rack gear and a plurality of pinion gears meshed with said arcuate rack gear; and means for securely mounting each of said plurality of louvers to an associated one of said plurality of pinion gears, comprising a transverse tab formed on the outer end of each of said plurality of pinion gears, and a slot formed in the narrow end of each of said louvers for engaging said transverse tab.

3. A shutter for curved windows comprising:

a frame having an inner frame member and an outer frame member;

a plurality of radially extending louvers, each of said plurality of louvers having a narrow end, a wide end, and two diverging lateral sides; and each being mounted to said inner frame member at said narrow end, and to said outer frame member at said wide end by means of a mounting pin extending into said outer frame member and into said wide end;

each of said plurality of louvers having an angular width spacing substantially equal to the spacing between each of said louvers, and the two diverging lateral sides of each of said louvers including a first lateral side which is tapered at an acute angle from front-to-back and a second lateral side which is tapered an acute angle from back-to-front; and a rack and pinion gear assembly in said frame for engaging synchronously said plurality of louvers, said assembly comprising a slidably mounted arcuate rack gear and a plurality of pinion gears meshed with said arcuate rack gear.

4. The shutter of claim 3, wherein the angle of taper of the first and second lateral sides is approximately 45°.

5. The shutter of claim 3, wherein the angle of taper of the first lateral side is substantially equal to the angle of taper of the second lateral side.

* * * * *